United States Patent [19]

Aldous

[11] Patent Number: 4,871,275

[45] Date of Patent: Oct. 3, 1989

[54] WINDOW WASHING DEVICE

[76] Inventor: Glenn R. Aldous, 5483 Blackrock Rd., Pocatello, Id. 83204

[21] Appl. No.: 211,770

[22] Filed: Jun. 28, 1988

[51] Int. Cl.[4] ..... A47L 1/08

[52] U.S. Cl. ..... 401/23; 401/22; 401/37; 401/188 R; 401/99; 401/44; 401/45; 401/46

[58] Field of Search ..... 401/16, 22, 23, 25, 401/26, 27, 37, 188 R, 139, 138, 137, 40–47, 99

[56] References Cited

U.S. PATENT DOCUMENTS

| | | | |
|---|---|---|---|
| 1,899,392 | 2/1933 | Larkin | 401/22 |
| 2,104,161 | 1/1938 | Koukal | 401/25 |
| 2,336,419 | 12/1943 | Pino | 401/22 |
| 2,722,701 | 11/1955 | Blum et al. | 401/139 |
| 2,746,071 | 5/1956 | Charun | 401/22 X |
| 3,549,265 | 12/1970 | Lorenz, Sr. | 401/25 |
| 3,640,630 | 2/1972 | Walker | 401/188 |
| 4,475,834 | 10/1984 | Bean | 401/99 |

FOREIGN PATENT DOCUMENTS

| | | | |
|---|---|---|---|
| 278014 | 12/1966 | Australia | 401/139 |
| 2408487 | 7/1979 | France | 401/27 |
| 2030849 | 4/1980 | United Kingdom | 401/27 |

*Primary Examiner*—Steven A. Bratlie

*Attorney, Agent, or Firm*—Hopkins French Crockett Springer & Hoopes

[57] ABSTRACT

A planar window washing device especially adapted to clean extremely soiled windows in a single washing step. The device comprises an elongate handle member and a cleaning head assembly. The cleaning head assembly includes a carrier member and first and second wiping means. The first wiping means is in the nature of a rubber squeegee and the second wiping means is in the nature of an abrasive pad which is movable between a first inoperative position and a second operative position in contact with the window surface.

7 Claims, 1 Drawing Sheet

WINDOW WASHING DEVICE

BACKGROUND OF THE INVENTION

Windows in commercial and residential buildings are typically washed in a two-step process: first, the window is washed with a soap-laden rag, mop, sponge, etc., and then the window is "squeegeed" dry with an elongate rubber blade. As modern architectural styles dictate an ever-increasing quantity of glass in multi-story buildings, the labor costs associated with performing this two-step cleaning process increase accordingly. Therefore, there is a need for a window washing device which is effective, easy-to-use, and results in labor savings.

Multi-element windshield washers are known to provide superior cleaning of curved automobile windshield surfaces. A number of patents have been issued on devices which are intended to remove road grime, in the form of bug debris, dirt, oil and gas residues, etc. Such patents include U.S. Pat. Nos. 3,089,175, 3,685,086, 3,939,524, German Offenlegungsschrifts Nos. 1,505,430 and 1,938,618.

SUMMARY OF THE INVENTION

The present invention comprises a window washing device especially adapted to provide one-step washing of planar window surfaces. The invention comprises an elongate handle which may be extensible, a pressurized fluid cleaning solution reservoir connected to the handle, and a cleaning head assembly also connected to the handle. The cleaning head assembly comprises a first wiping means, in the nature of a rubber squeegee, and a second wiping means, in the nature of an abrasive pad. The second wiping means is deformed or moved from a first inoperative position (not in contact with the window) to a second operative position in contact with the window to be cleaned. The second wiping means may be activated by the pressurized cleaning solution, as by a trigger on the handle, to provide pressurized fluid to the cleaning head assembly. Preferably, the pressurized cleaning fluid may be applied to the window either through the second wiping means or adjacent to the second wiping means while the second wiping means is in its second operative position. Upon release of the pressure from the reservoir, the second wiping means returns to its first inoperative position and the cleaning fluids/dirt may be squeegeed from the window surface with the first wiping means.

DETAILED DESCRIPTION OF THE INVENTION

Figure 1:
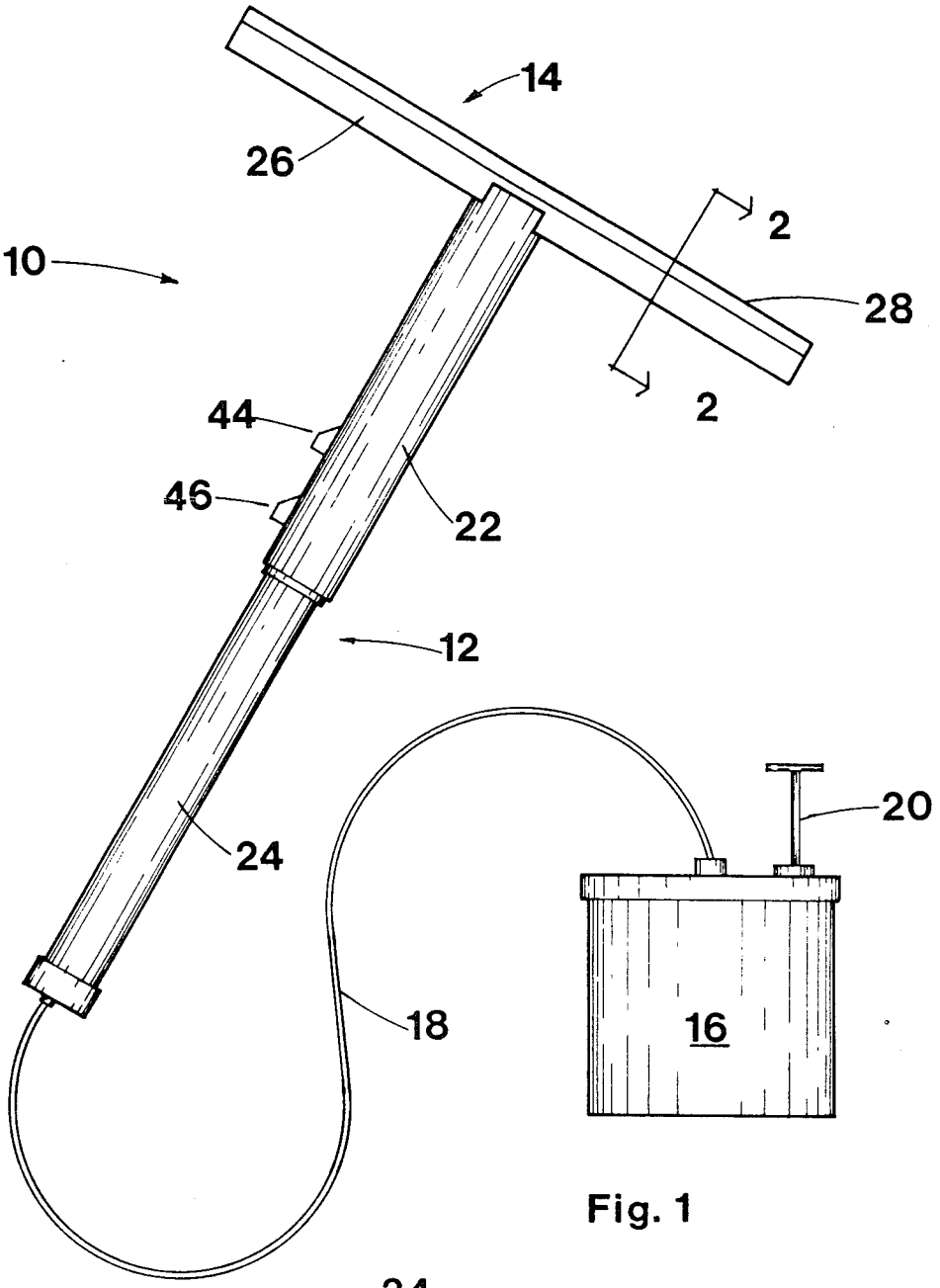
FIG. 1 is a schematic representation of the window washing device of the present invention.

As illustrated in FIG. 1, in its broadest embodiment the present invention generally comprises a window washing device 10 having an elongate handle 12 and a cleaning head assembly 14. The window washing device 10 may be connected to a fluid reservoir 16 by conduit 18. Pressurized fluid cleaning solution is contained within reservoir 16 and supplied to the cleaning head assembly 14 through conduit 18 and elongate handle 12.

The conduit 18 may be extended within the elongate handle 12 to the cleaning head assembly 14, or it may be affixed to the elongate handle 12 and the entire handle 12 may be filled with the cleaning solution. Alternatively, the conduit 18 may be affixed directly to the cleaning head assembly. The reservoir 16 is preferably pressurized so that the cleaning fluid provided to the cleaning head assembly 14 is under positive pressure. The reservoir 16 may be pressurized either by externally supplied compressed gases or may be pressurized by a conventional hand pump 20 affixed to the reservoir 16.

Preferably, the elongate handle 12 is provided as a telescoping assembly having at least two telescoping handle members 22, 24. In certain environments, it may be desirable to provide the elongate handle 12 with a number of telescoping members so as to provide a device capable of being extended a significant distance.

Figure 2:
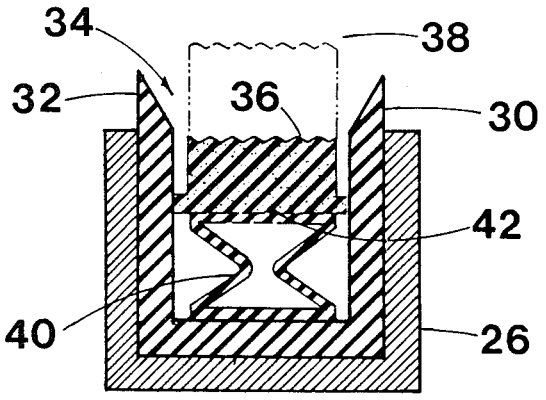
FIG. 2 is a view taken along lines 2—2 of FIG. 1.

The cleaning head assembly 14 is provided with carrier member 26 affixed to the handle 12. Attached to the carrier member 26 is a first wiping means 28, preferably in the form of a planar rubber squeegee extending the length of the carrier 26. In one embodiment of the invention, illustrated in FIG. 2, the first wiping means is provided as a pair of squeegee members 30, 32 which extend beyond the carrier member 26. Second wiping means 34 is illustrated in FIG. 2 in a "first inoperative position", meaning that it is not in contact with the planar window surface to be washed. The second wiping means 34 is preferably provided in the form of an abrasive-type pad having a surface 36 adapted to remove particulate and nonaqueous matter from a window surface. The second wiping means is deformed, or moved, from its first inoperative position into a second operative position 38, illustrated in FIG. 2 by broken lines. In the second operative position, the second wiping means 34 extends beyond the squeegee portions 30, 32 so as to be in contact with the window surface for removal of hard-to-remove materials therefrom.

In the embodiment illustrated in FIG. 2, the second wiping means 34 is deformed from its first inoperative position (solid lines) to its second operative position (broken lines) by the action of bladder 40. When pressurized cleaning fluid is directed from reservoir 16 through the elongate handle 12 and into the cleaning head assembly 14, the fluid enters the bladder member 40 whereupon the member expands and deforms or pushes the second wiping means 34 from its first inoperative to its second operative position. In the embodiment of FIG. 2, the bladder member 40 may be provided with a plurality of apertures 42 which are sized to permit inflation of bladder 40 while they at the same time permit cleaning fluid to be dispensed into the second wiping means 34, and thereupon onto the window surface to be cleaned. In the embodiment illustrated, the second wiping means has a porous structure permitting cleaning fluid to be dispensed therethrough.

In operation, the individual charged with washing a number of windows would fill the reservoir 16 with cleaning fluid and then pressurize reservoir 16 either with a conventional hand pump 20 or by any other method reasonably known and available to those of ordinary skill in the art. The telescoping sections 22, 24 of the elongate handle 12 are then positioned to a length appropriate to the particular job, and a first button or trigger 44 may be depressed to direct the pressurized cleaning fluid from reservoir 16 into the bladder member 40, and thence into the second wiping means, in its second operative position. After sufficient scrubbing with the second wiping means has loosened the dirt or grime on the window surface, trigger 44 may be released, permitting the second wiping means to return to its first inoperative position and the cleaning solution can be squeegeed from the window surface with members 30, 32. Any number of buttons or triggers may be provided on the elongate handle 12 to perform a number of different functions. For example, a second pressurized fluid reservoir (not shown) may be interconnected t the cleaning head assembly 14 and activated by button or trigger 46. For example, the second reservoir may contain water, ammonia, or various other and different cleaning solutions.

It is to be understood that the embodiment disclosed in FIGS. 1 and 2 is merely representative of the broad range of physical embodiments the present invention may assume. For instance, a single first wiping means 28 (rather than the pair shown in FIG. 2) may be utilized; the elongate handle 12 may be provided as a single nonextensible member; the cleaning fluid may be pressurized by any available technology. It should especially be appreciated that the second wiping means may be moved from its first inoperative to its second operative position by any one of a large number of mechanical means, and that the bladder configuration disclosed herein is illustrative only. Any mechanism which moves the second wiping means from the first inoperative to the second operative position is useful herein. Likewise, the cleaning fluid reservoir may be contained solely in the handle rather than remote thereform, or in any other manner which will make the fluid accessible t the cleaning head assembly under pressure.

While a preferred embodiment of the invention has been disclosed, various modes of carrying out the principles disclosed herein are contemplated as being within the scope of the following claims. Therefore, it is understood that the scope of the invention is not to be limited except as otherwise set forth in the claims.

I claim:

1. A window washing device, comprising:

a. an elongate handle operatively connected to a pressurized cleaning fluid reservoir;

b. a cleaning head assembly affixed to the handle and having (i) first wiping means adapted to remove aqueous films from a planar window surface, (ii) second abrasive wiping means adapted to remove particulates and nonaqueous fluid films from said window surface, (iii) actuating means interconnected with the pressurized cleaning fluid reservoir such that when activated the second wiping means is deformed from a first inoperative position not in contact with said window surface to a second operative position in contact with said window surface, (iv) means delivering the pressurized cleaning fluid to the window through the second abrasive wiping means when the actuating means is actuated; and c. trigger means adjacent the elongate handle to enable an operator to manually activate the actuating means.

2. The device as recited in claim 1, wherein said first wiping means comprises at least one rubber squeegee member.

3. The device as recited in claim 1, wherein the actuating means comprises an elongate bladder disposed within the cleaning head such that when the pressurized cleaning fluid is directed to the bladder, the bladder enlarges and deforms the second abrasive wiping means to the second operative position.

4. The device as recited in claim 3, wherein said bladder is provided with a plurality of apertures therein such that pressurized cleaning fluid is enabled to bleed therethrough into the second abrasive wiping means.

5. A window washing device, comprising:

a. an elongate handle operatively connected to a pressurized cleaning fluid reservoir;

b. a cleaning head assembly aligned perpendicular to the handle at the end thereof and in fluid communication therewith, and having (i) first wiping means adapted to remove aqueous films from a planar window surface, (ii) second abrasive wiping means adapted to remove particulates and nonaqueous fluid films from said window surface, and (iii) actuating means within said cleaning head assembly in the form of a bladder affixed to the second abrasive wiping means and interconnected to said pressurized cleaning fluid reservoir; and c. trigger means adjacent the elongate handle to enable an operator to manually activate the actuating means and permit pressurized cleaning fluid to be directed to the bladder, thereby deforming the second abrasive wiping means.

6. The device as recited in claim 5, wherein said bladder is provided with a plurality of apertures therein directing pressurized cleaning fluid from said bladder into said second abrasive wiping means.

7. A window washing device, comprising:

a. an elongate handle operatively connected to a pressurized cleaning fluid reservoir;

b. a cleaning head assembly aligned perpendicular to the handle at the end thereof and in fluid communication therewith, and having (i) first wiping means adapted to remove aqueous films from a planar window surface, (ii) second abrasive wiping means adapted to remove particulates and nonaqueous fluid films from said window surface, said second abrasive wiping means interconnected with the pressurized cleaning fluid reservoir such that cleaning fluid is delivered to the window through the second abrasive wiping means, and (iii) mechanical actuating means to deform the second abrasive wiping means from a first inoperative position not in contact with said window surface to a second operative position in contact with said window surface; and c. trigger means adjacent the elongated handle to enable an operator to deliver pressurized cleaning fluid to the second abrasive wiping means.

* * * * *